United States Patent [19]

Raiha

[11] 4,411,105

[45] Oct. 25, 1983

[54] PRECISION DRILL BIT RESURFACING TOOL

[76] Inventor: Antti P. Raiha, Rte. #1, Box 512, Sandpoint, Id. 83864

[21] Appl. No.: 286,334

[22] Filed: Jul. 23, 1981

[51] Int. Cl.[3] ..... B24B 3/28

[52] U.S. Cl. ..... 51/124 R; 51/127; 51/216 ND; 51/219 PC; 51/5 D

[58] Field of Search ..... 51/94 R, 96, 124 R, 51/126, 128, 127, 216 ND, 219 R, 219 PC, 288, 5 D; 279/5; 269/76

[56] References Cited

U.S. PATENT DOCUMENTS

| | | | |
|---|---|---|---|
| 2,321,383 | 6/1943 | Harper | 51/101 LG |
| 2,580,884 | 1/1952 | Bowman | 51/124 R X |
| 2,614,370 | 10/1952 | Kapnick | 51/124 R X |
| 2,632,983 | 3/1953 | Kapnick | 51/219 PC |
| 2,701,432 | 2/1955 | Kent | 279/5 |
| 2,902,800 | 9/1959 | Hoberecht | 51/219 R |
| 3,073,076 | 1/1963 | French | 51/124 R X |
| 3,197,924 | 8/1965 | Mitchell | 51/219 R |
| 3,482,325 | 12/1969 | Mitchell | 51/219 R X |
| 4,142,332 | 3/1979 | Clarke | 51/219 R X |

*Primary Examiner*—Frederick R. Schmidt
*Assistant Examiner*—Robert P. Olszewski
*Attorney, Agent, or Firm*—Flam & Flam

[57] ABSTRACT

The drill grinder includes a drill bit holder mounted for movement about a swing axis provided by a rocker arm. The swing axis parallels the plane of the grinding wheel. An index ring mounted on the holder provides precise indexing of the drill bit. The extent of micrometric feed movement of the rocker arm is precisely marked so that such movement can be exactly duplicated as to all lip surfaces, thus achieving a symmetrically surfaced drill bit. These structures are integrated in a system that provides simple adjustment for drill bit size, clearance angle and contour control of lip surface.

9 Claims, 23 Drawing Figures

260
262
264
180
206
188
186
208
184
18
20
16
22
A
B
212
190
194
198
204
200
202
196
192
182
220
218
216
228
226
224
254
222
252
250
230
210
214
8
7

PRECISION DRILL BIT RESURFACING TOOL

FIELD OF INVENTION

This invention relates to drill grinders.

BACKGROUND OF THE INVENTION

Various tools have been designed for the purpose of surfacing and/or resurfacing fluted drill bits. Many such tools carefully control the chisel angle, lip clearance angle and, in some instances, the included point angle and curvature. Often neglected in small resurfacing tools is the symmetrical treatment of both (all) lips and lip surfaces. Thus, unless the lips are very symmetrically resurfaced, one of the lips will predominate in the cutting process with consequent loss of cutting efficiency and consequent overload of one part of the drill. Accordingly, the primary object of the present invention is to provide a compact, reliable and relatively simple bench tool for resurfacing drill bits so that the treatment of both (all) lips is precisely symmetrical, while allowing the necessary adjustments of lip clearance and chisel edge angle to be carefully controlled.

Another object of the present invention is to provide an improved drill bit resurfacing tool in which adjustments for clearance angle, drill bit size and curvature are easily and reliably made. Still another object of the invention is to provide an improved system for mounting the tool adjacent a bench grinder so that initial set up and subsequent calibration is easily achieved for those models that do not include a grinder.

SUMMARY OF INVENTION

In order to accomplish the foregoing objectives, I provide a drill bit holder that is pivotally mounted on a bearing block so that the axis of pivotal movement parallels and is slightly spaced from the outer accessible side face of a grinding wheel. The bit holder incorporates parts of securing a drill bit in position so that one of the drill bit lips to be resurfaced precisely parallels the pivot axis, the pivot axis being just beneath the axis of the drill bit, and the drill bit being held at its proper point angle. Angular movement of the bit holder about its pivot axis with the drill bit lip at the grinding wheel, causes successive portions of the lip surface to move into position with the grinding wheel, and to grind away any metal projecting beyond a cylindrical locus centered at the pivot axis of the holder.

Control of the bearing block position relative to the grinding wheel surface, together with control of the starting attitude of the bit holder, provide accurate grinding of the lip surface. The bearing block takes the form of a relatively large rocker arm pivoted on a carriage. The rocker arm is movable about a horizontal axis parallel to the grinding wheel surface. Assuming initial calibration by adjustment of the carriage and by diamond trimming of the grinding wheel, the rocker arm is first adjusted so that the bit holder axis is at a distance from the grinding wheel surface suitable for the size of the bit. Next, a stop operative between the bearing block and the bit holder is adjusted to determine the starting attitude of the drill bit, thereby to determine clearance angle. The bit holder fixtures are set for control of chisel angle. An actuator operates an eccentric for micrometrically advancing the pivot block from a starting position, thereby to provide a very small range of movement for grinding away and renewing the lip surface. The required extent of movement of the actuator may be more or less, depending upon the condition of the drill bit. In any case, the extent of movement is carefully marked by a gauge rod so that upon indexing of the drill bit to its new lip position, precisely the same amount of actuator movement is applied so that precise symmetry is obtained.

BRIEF DESCRIPTION OF THE DRAWINGS

A detailed description of the invention will be made with reference to the accompanying drawings wherein like numerals designate corresponding parts in the several figures. These drawings, unless described as diagrammatic or unless otherwise indicated, are to scale.

DETAILED DESCRIPTION OF THE PREFERRED EMBODIMENT

The following detailed description is of the best presently contemplated mode of carrying out the invention. This description is not to be taken in a limiting sense, but is made merely for purposes of illustrating the general principles of the invention, since the scope of the invention is best defined by the appended claims.

(a) TOOL HOLDER, PIVOT BLOCK, GENERAL ORGANIZATION AND DRILL BIT GEOMETRY

Figures 1, 4A:
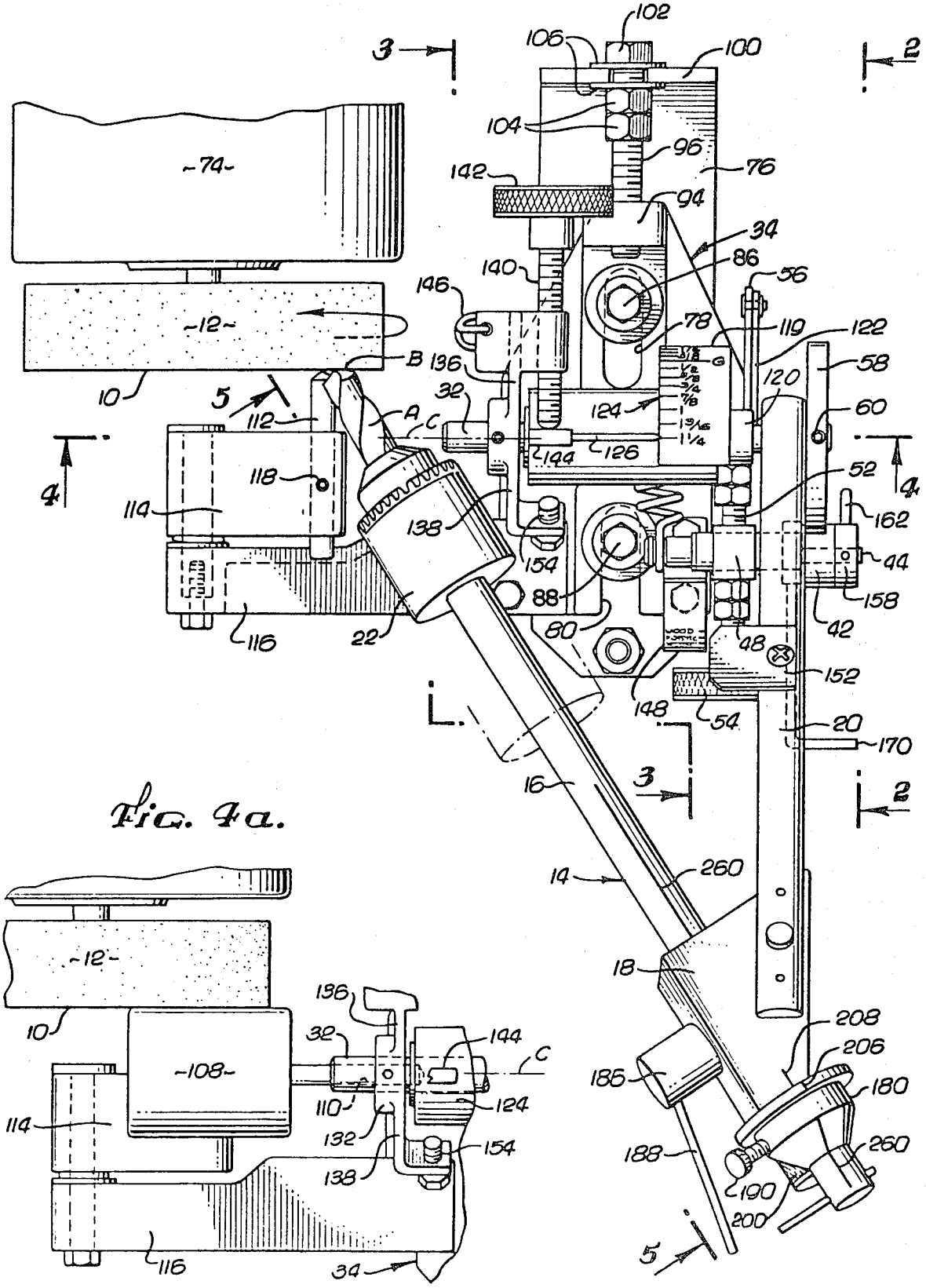
FIG. 1 is a top plan view of a precision drill bit resurfacing tool incorporating the present invention.
FIG. 4*a* is a diagrammatic view illustrating the use of a gauge for bench set-up purposes.

Illustrated in FIG. 1 is a two-fluted twist bit A having one of its lips B positioned at the side surface 10 of a motorized grinding wheel 12. The bit A is held in its particular attitude by a holder 14.

The bit holder 14 includes a cylindrical arbor 16 slidably fitted to a housing 18 and to which it is releasably clamped. The housing 18 is rigidly connected to the distal end of a post 20. The post 20 and the arbor 16 are held in a fixed skew relationship of about 30° by the housing 18, while the housing allows angular adjustment of the arbor about its own axis as well as longitudinal adjustment of the arbor for purposes of determining and holding a chisel point angle.

Figure 14:
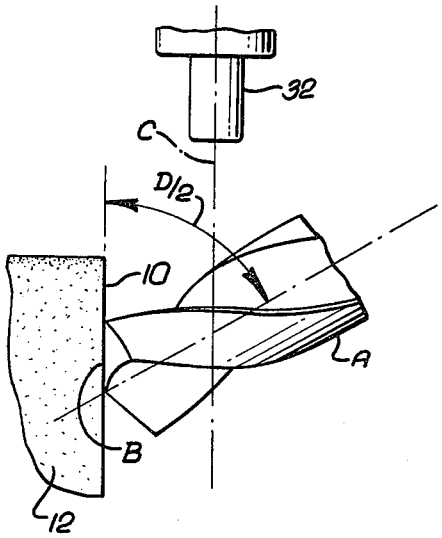
FIGS. 14 and 15 are companion fragmentary diagrammatic top plan views showing drill bits of different sizes at the grinding wheel.
Figure 15:
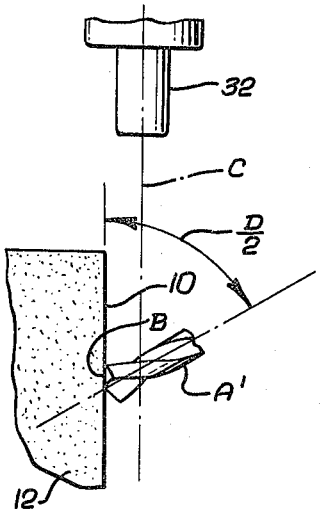
Figure 16:
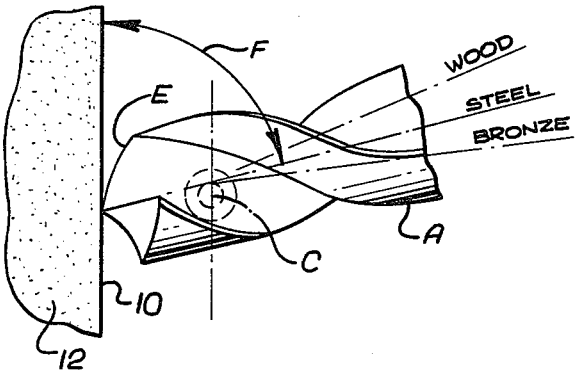
FIGS. 16, 17, 18 and 19 are companion diagrammatic front elevational views showing different attitudes of the two drill bits, respectively.
Figure 17:
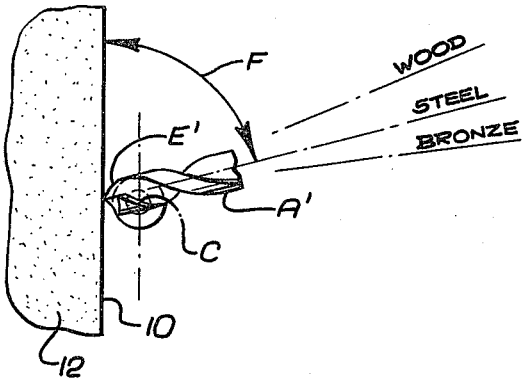
Figure 18:
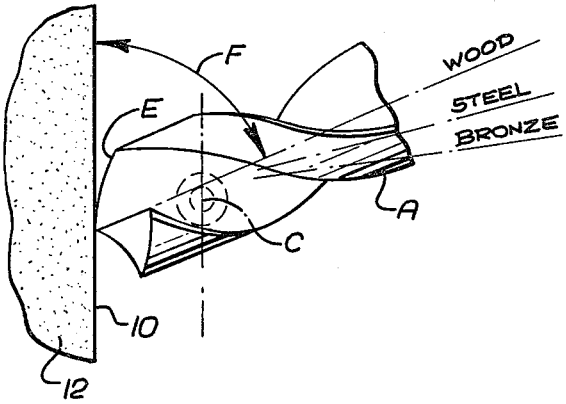
Figure 19:
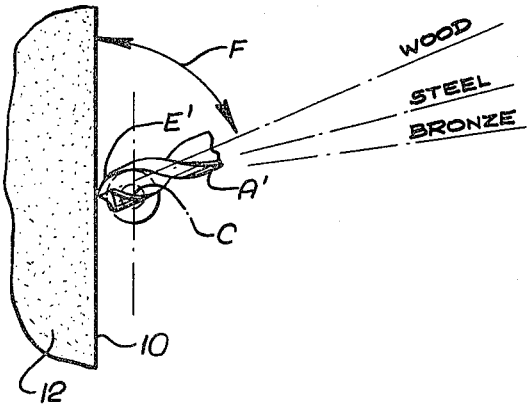

The arbor 16 carries a device for securely holding the bit. In the present instance, a conventional key operated chuck 22 is provided for use with small cylindrical shank drill bits. The attitude of the drill bit A relative to the grinding wheel 12 is determined by the fixed angular relationship of the post 20 and the arbor 16, as well as by the pivot mounting of the post 20 on a horizontal swing axis C (FIG. 4) that parallels and extends substantially diagonally in front of the grinding wheel surface 10. This fixed angularity establishes the drill point angle D (FIGS. 14 and 15) which is the angle of the drill lip B relative to the axis of the bit A. In practice, only very few drill bits are designed for a drill point angle different from an established standard. Hence, adjustment as such is, in the present instance, compromised in the interests of simplicity and rigidity of mechanism. Should a different drill point angle be desired, a different bit holder 14 is substituted.

FIGS. 14 through 19 illustrate the swing axis C and two precisely finished drill bits A and A′—one larger, one smaller. By the aid of a chisel angle gauge later to be described, the lip B or B′ is placed exactly horizontally and parallel to the swing axis C so that when the bit holder moves angularly in a counter-clockwise direction about the axis C, a lip surface E or E′ of cylindrical contour is accurately formed.

In practice, the drill bit is surfaced by micrometrically advancing the axis C towards the grinder surface 10 as the bit holder is moved about its swing axis C. The initial distance of the axis C from the grinder surface is set by a gauge to establish a proper radius of curvature according to drill bit size. Compare FIGS. 14, 16 and 18 of FIGS. 15, 17 and 19. Furthermore, by a cam mechanism to be described later, the position of the axis C relative to the grinder surface 10 may be changed as a function of bit holder swing position, whereby a surface deviating from a cylindrical contour may be achieved. Moreover, the starting angle of the tool holder can be adjusted, as indicated by the legends WOOD, STEEL and BRONZE.

(b) ROCKER ARM, DRILL BIT SIZE ADJUSTMENT

Figure 2:
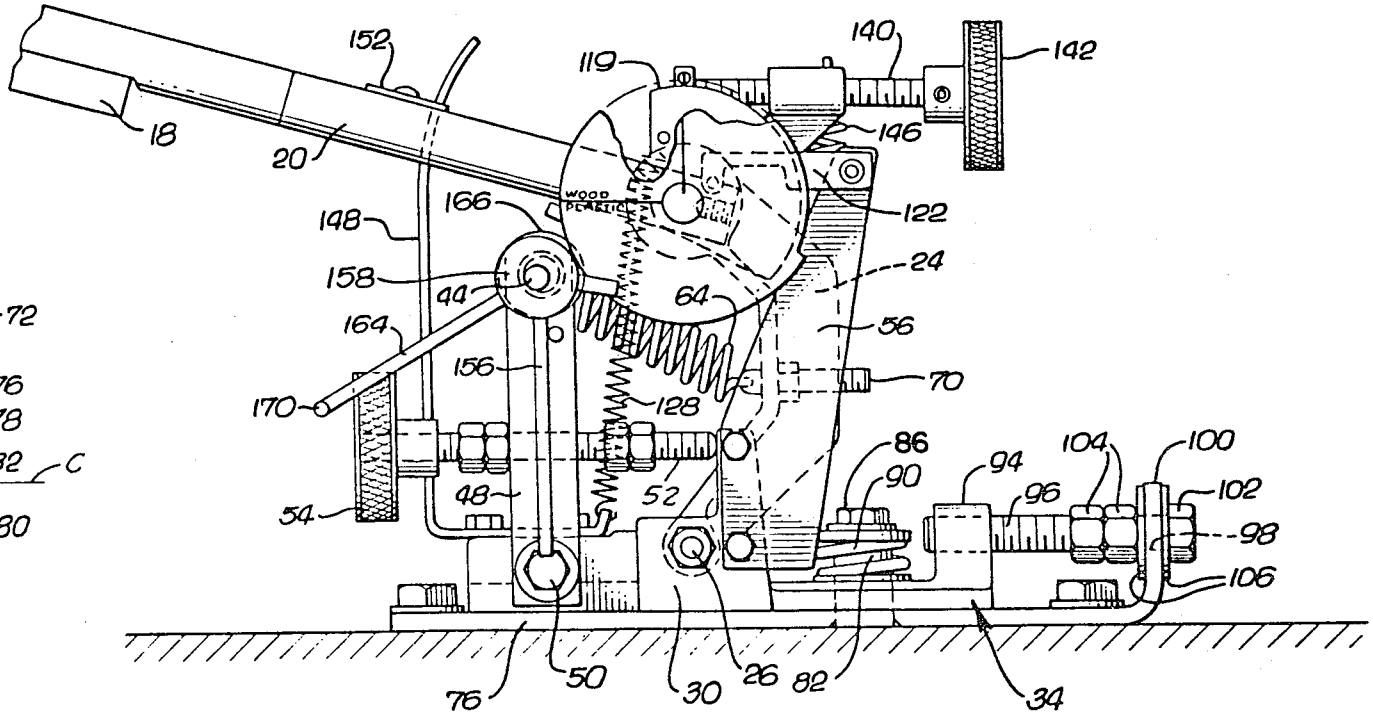
FIG. 2 is a rear elevational view taken in the direction of the plane indicated by lines 2—2 of FIG. 1 and illustrating the eccentric feed actuator and other mechanisms.
Figure 4:
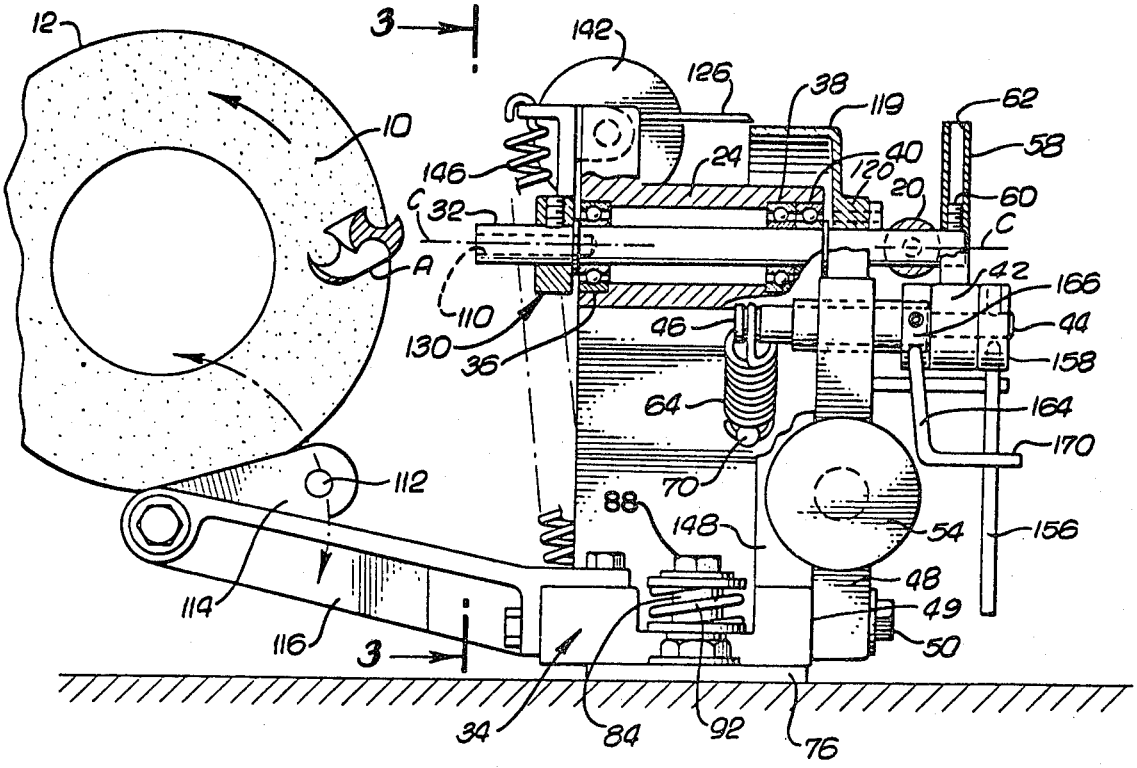
FIG. 4 is a transverse sectional view through the pivot axis of the tool holder, and taken along the plane indicated by lines 4—4 of FIG. 1.
Figure 9:
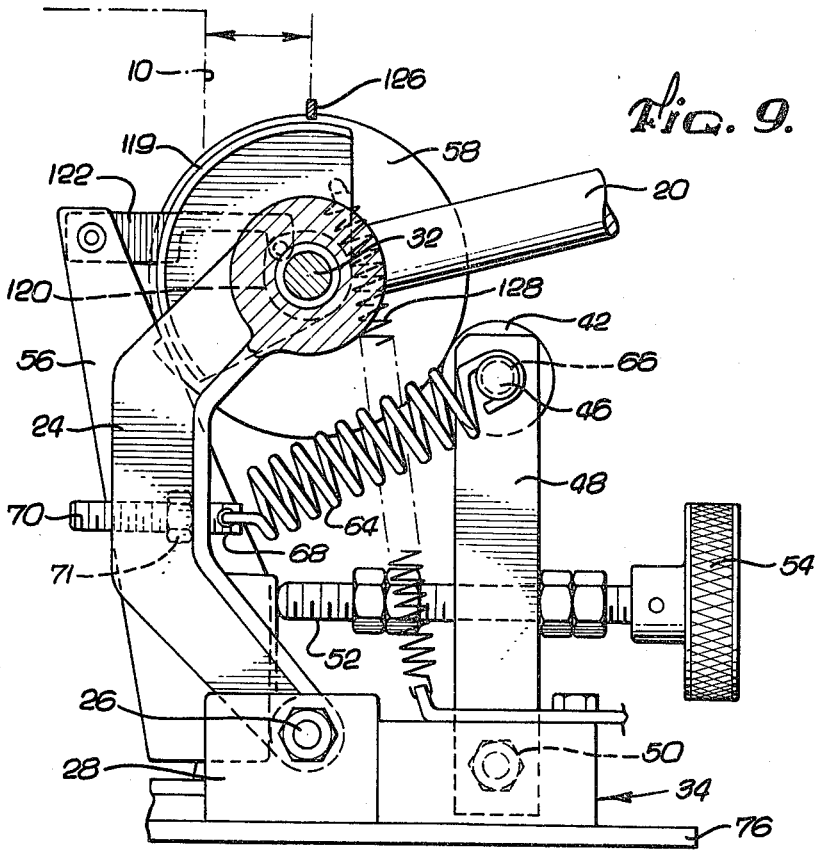
FIGS. 9 and 10 are front elevational views of the rocker arm on an enlarged scale as compared to FIG. 3, only part of the apparatus being shown and the pivot block for the bit holder being shown in section, the companion views illustrating the adjustment of the rocker arm for drill bit size.
Figure 10:
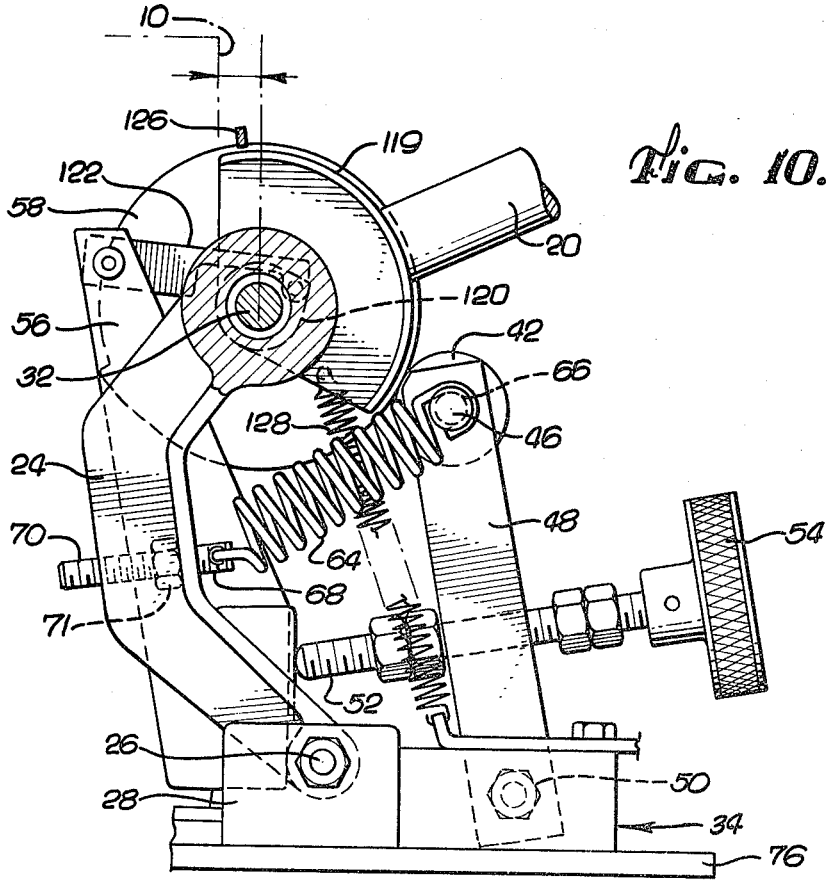

The swing axis C for the bit holder 14 is determined by a pivot block in the form of a fairly massive rocker arm 24 shown in the rear view, FIG. 2, and in the front view, FIGS. 9 and 10. The lower end of the rocker arm 24 is mounted on a horizontal pivot pin 26 extending through spaced upstanding side walls 28 and 30 of a carriage 34. The upper end of the rocker arm 24 supports a swing axle 32 as by precision bearings 36, 38 and 40 (FIG. 4). The swing axle 32 projects beyond both front and rear ends of the rocker arm 24. The rear projecting end of the swing axle 32 is rigidly secured to the bit holder post 20 whereby the bit holder is swingably mounted.

The rocker arm 24 is urged away from the grinding wheel surface or in a clockwise direction as viewed in FIGS. 9 and 10, and against a stop. The stop includes a feed roller 42, the feed function of which will be hereinafter described. The roller 42 is mounted on an eccentric reduced extension 44 of a feed shaft 46 journalled on a tiltable standard 48. The standard 48 forms the main part of a stop mechanism for the rodker arm 24. See also FIGS. 9 and 10. The tiltable standard 48 is pivotally attached at its lower end to a vertical surface 49 at the rear of the carriage 34 (FIG. 4) by the cylindrical shank of a screw 50. The tiltable standard 48 carries a jack screw 52 (FIG. 2) operated by a knob or handle 54. The jack screw 52 engages a lug 56 (see also FIG. 2) projecting upwardly at the rear of the carriage. Assuming that the tiltable standard 48 is urged in a counterclockwise direction as viewed in FIGS. 9 and 10, the tilt position of the standard 48 relative to the carriage is determined by the position of the jack screw 52. Correspondingly, the position of the stop or feed roller 42 relative to the carriage is determined.

The stop or feed roller 42 is engaged by a lip surface contour cam 58. As shown in FIG. 4, this contour cam 58 is fixed to the very end of the swing axle 32 by the aid of a set screw 60 accommodated in a peripherally opening radial recess 62.

The rocker arm 24 and the tiltable standard 48 are urged towards each other and the standard 48 is urged against the lug 56 by the aid of a coil spring 64. As shown in FIGS. 1, 4 and 9, the spring is anchored at one end in an annular groove 66 formed at the forwardly projecting end of the feed shaft 46. The other end of the spring is anchored by a transverse hole 68 of a screw 70. The screw 70 projects through and is affixed to the rocker arm 24 to locate the mounting hole 68 on the feed shaft side of the rocker arm. A nut 71 locks the screw in position to determine nominal spring tension. The spring 64 urges the standard 48 towards the lug 56 by virtue of the fact that the axes of the mounting hole 68, mounting groove 66, pivot screw 50 and pivot pin 26 (FIG. 9) define a trapezoid in which the side corresponding to the coil spring 64 shortens when the jack screw 52 allows counterclockwise movement of the feed shaft standard 48.

The initial positioning of the stop or feed roller 42, the jack screw 52 and, correspondingly, the initial positioning of the swing axle 32 and swing axis C, corresponds to the size or diameter of the drill bit to be resurfaced. See FIGS. 14 to 19.

(c) CARRIAGE MOUNT

In order for the jack screw 52 to achieve such appropriate spcing, and in order to achieve proper operation in other respects, precise parallelism must be established between the axes of the various parts mounted by the carriage 34 and the plane of the grinding wheel surface 10.

For setup purposes, the jack screw 52 is moved to an arbitrary gauge position G indicated by a dial mechanism hereinafter to be described. With the jack screw 52 and, hence, the swing axle 32 in a fixed position relative to the carriage 34, the carriage is mounted on the same bench 72 (FIG. 1*a*) as is the grinder 74. The carriage 34 is mounted on a base plate 76 for horizontal movement in a straight line. To achieve such slidable mounting, the base plate 76 carries two vertical pins that cooperate with slots 78 and 80 (see also FIG. 1) formed at the ends of the carriage. The pins take the form of collars 82 and 84 carried by or formed as the shanks of machine screws 86 and 88. See also FIG. 2. Relatively heavy coil springs 90 and 92 captured by the heads of the screws 86 and 88 firmly seat the carriage 34 on the mounting plate 76.

The carriage provides a lug 94 (FIGS. 1 and 2) in which a lead screw 96 is mounted. The lead screw 96 is held in a fixed axial position on the base plate 76. For this purpose, the lead screw extends through an aperture 98 of an upstanding bracket 100 at the end of the base plate. The lead screw 96 has a head 102 held against the outside of the bracket by lock nuts 104. Washers 106 are interposed on opposite sides of the bracket 100. By turning the head 102 with the lock nuts 104 released, the carrriage is caused to move in a straight line as determined by the pin and slot mounting of the carriage.

Figure 1A:
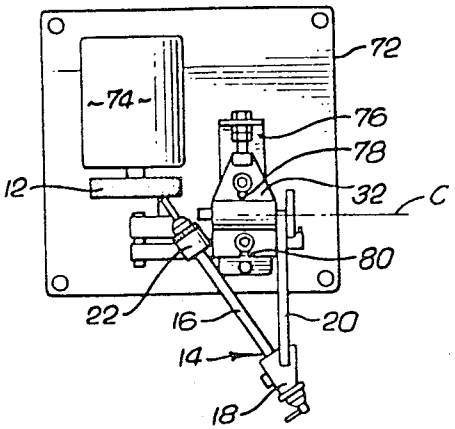
FIG. 1*a* is a top orientation view showing the bench mounting of the tool adjacent a grinder.

For purposes of first installation, the carriage is moved to one end of the mounting plate, or downwardly as viewed in FIGS. 1 and 1*a*. With the carriage near the end of its travel, the base plate 76 is positioned behind the grinder 74. A cylindrical gauge 108 (FIG. 4*a*) of an arbitrary size but correlated to the arbitrary gauge position G of the jack screw 52 is attached to the swing axle 32. For this purpose, the front end of the swing axle 32 provides a socket 110 in which the gauge 108 fits. With the gauge 108 so fitted, the base plate 76 is moved to a position such that the gauge 108 flatly engages the grinding wheel surface 10 at or preferably slightly above the 3:00 o'clock position. The base plate 76 is then firmly fastened to the bench. The drill bit grinder and bench grinder could be provided as a unit on a common base, factory calibration then obviating the setup procedure described.

(d) DIAMOND CALIBRATION OF GRINDING WHEEL SURFACE

After the base plate 76 is firmly fastened, and after the gauge 108 is removed, the grinding wheel 12 is power operated so that its grinding surface is trimmed to perfect flatness in a calibrated relationship to the grinder mechanism. For this purpose, a diamond tipped rod 112 (FIGS. 1 and 4) is provided. The rod 112 is mounted near the end of a crank arm 114. The crank arm is pivotally mounted at the outboard end of a cantilever bracket 116 attached to the front side of the carriage 34. The pivot axis of the crank arm 114 is precisely perpendicular to a vertical plane extending through the axis of the swing axle 32.

As shown in FIG. 4, the crank arm 114 is normally folded back along the cantilever bracket 116 so as to clear the grinding wheel 12 well beneath and, thus, out of the way of the drill bit holder 14 and the drill bit chuck 22. However, by swinging the crank arm 114, the diamond tipped rod 112 sweeps across the grinding wheel surface. The rod, properly set at the factory as by a dowel pin 118 (FIG. 1), will lightly trim the surface 10 to ensure its perfect flatness and parallelism. The tool grinder may now be operated.

After each use or after a small number of uses of the device, the surface 10 is renewed. This is done by movement of the carriage lead screw 96 by an amount sufficient to provide interference or negative clearance between the diamond tipped rod 112 and the grinder wheel. The crank 114 is then caused to sweep across the grinding wheel surface.

(e) DRILL BIT SIZE AND GAUGE DIAL

As the first step in setting up the apparatus, the jack screw 52 for the tilt screw standard is adjusted to the size of the drill bit to be ground. The position of the rocker arm 24 and, correspondingly, the position of the swing axle 32 is indicated by a dial 119 (FIGS. 2, 4 and 9). In the present instance, the dial 119 has a hub 120 which is journalled on the swing axle 32 just inboard of the tool holder mounting post 20, as shown in FIG. 4. A crank mechanism rotates the dial 119 as the rocker arm 24 is moved. For this purpose, the carriage lug 56 carries a crank link pin 122 connected to the hub 120. See also FIG. 4.

The dial 119 has suitable markings 124 (FIG. 1) directly readable in drill bit size. These markings 124 cooperate with a pointer 126. One of the markings reads "G" for gauge position, discussed previously. A light coil spring 128 attached to the dial 119 takes up slack and ensures a reliable reading.

(f) CLEARANCE ANGLE ADJUSTMENT

By the aid of a chisel angle control mechanism hereinafter to be described, one of the two drill bit lips B is set so that it extends horizontally across the grinding wheel in its initial addressed position and as shown in FIGS. 14 to 19. The bit holder 14 positions the drill bit so that the swing axis C is offset beneath the axis of the drill bit. Since the axis C is offset, the clearance angle provided by the grinding operations depends upon the initial angularity of the drill bit axis. Thus, the starting angle F FIGS. 16 to 19) determines the clearance angle of the lip surface.

Figure 3:
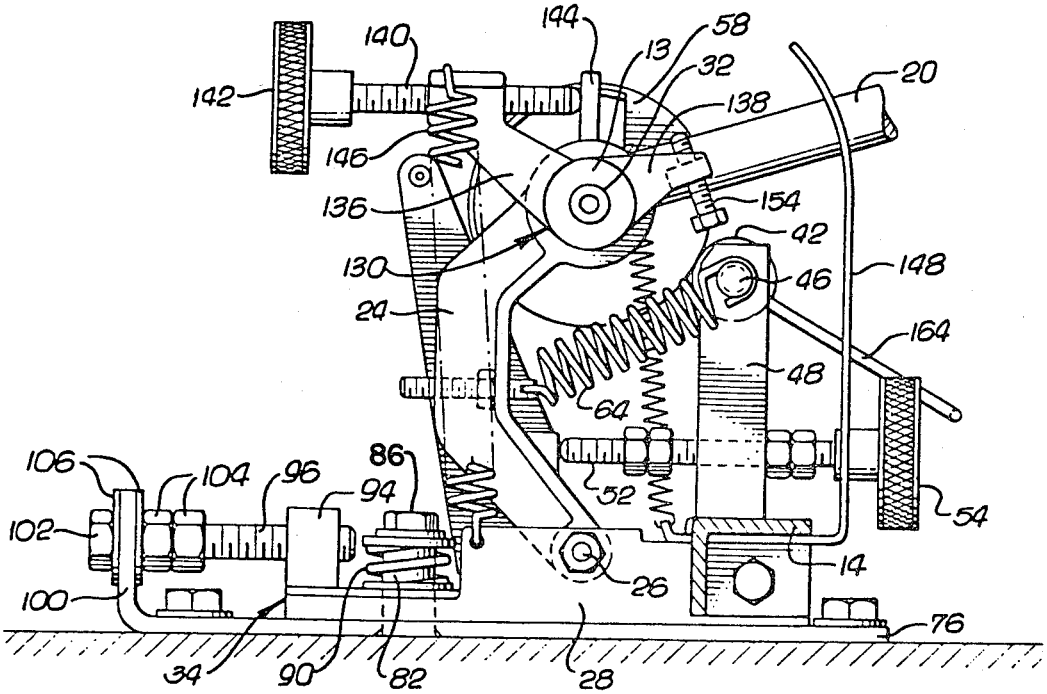
FIG. 3 is a sectional view taken generally at the front and in the direction of the offset plane indicated by lines 3—3 of FIG. 1, part of the drill bit holder being broken away.
Figure 11:
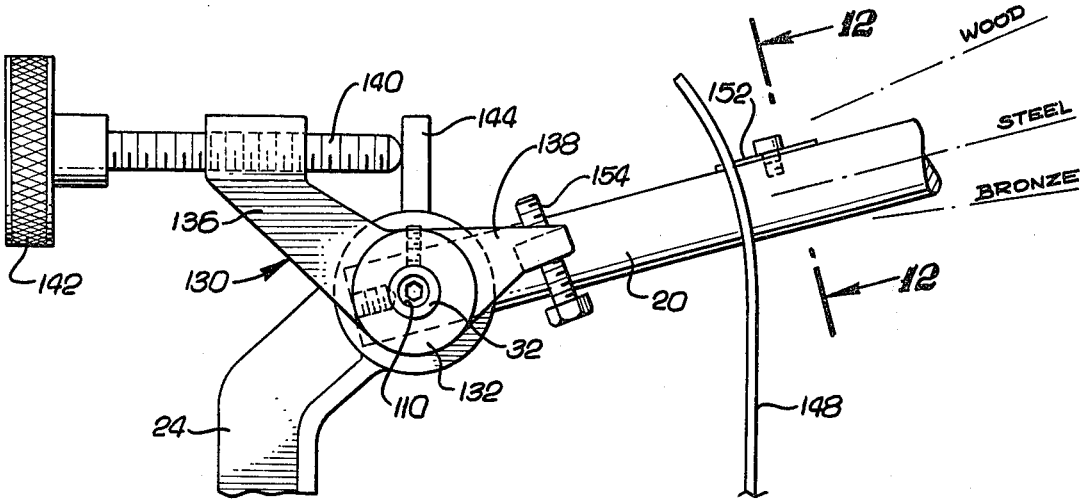
FIGS. 11 and 12 are fragmentary front elevational views of the adjustable stop mechanism for the rocker arm, the companion views illustrating adjustments of the bit holder for different clearance angles.
Figure 12:
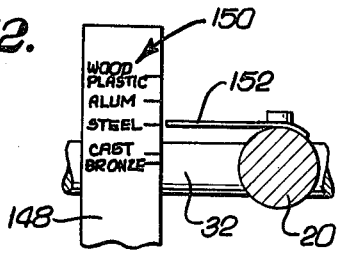
Figure 13:
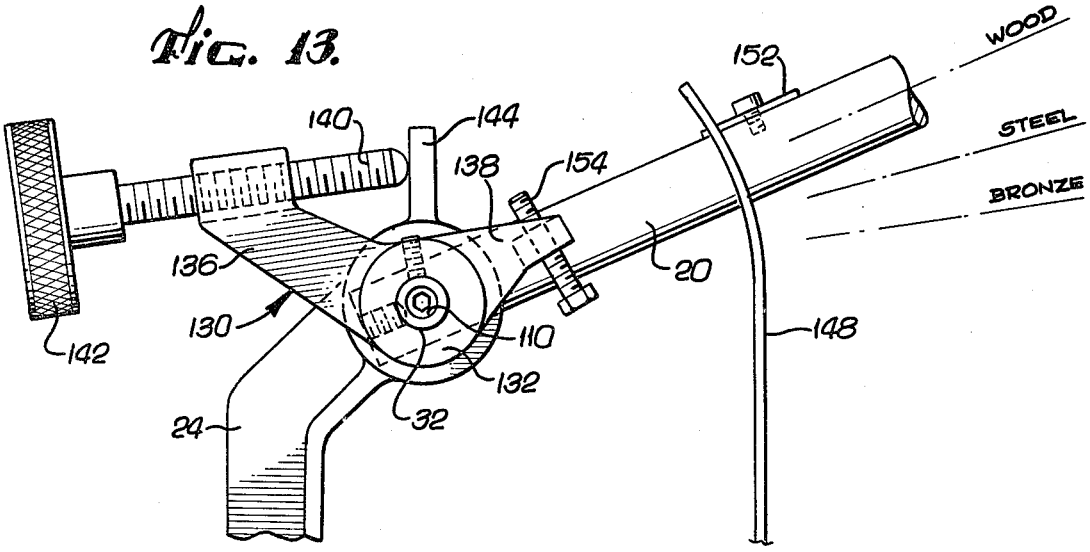
FIG. 13 is a sectional view taken along a plane indicated by lines 13—13 of FIG. 11.

In order to determine the starting angle F, a stop mechanism is provided to be operative between the drill bit holder or its swing axle 32 on the one hand, and the bearing block or rocker arm 24 on the other. This mechanism is shown generally in FIG. 3, but in better detail in FIGS. 11, 12 and 13. This stop mechanism includes an angled stop bracket 130 having a hub 132 secured to the frontal end of the swing axle 32. The bracket 130 also has a pair of spaced generally radially extending arms 136 and 138. One of the arms 136 carries an adjusting screw 140 with a turning knob 142 at one end. The other end of the adjusting screw 140 is positioned to describe a path of movement intercepted by a generally vertical stop or wall 144 projecting upwardly from the rocker arm 24. The weight of the tool holder rotates the swing axle 32 in a clockwise direction as viewed in FIG. 3, causing the adjusting screw 140 to engage the stop 144. A spring 146 only partly counterbalances the weight of the holder 14. For this purpose, the spring 146 attaches to the arm 136 at one end, and to the carriage 34 at the other.

By turning the knob 142, the starting angular position of the drill bit is determined to provide or comport with an appropriate lip clearance angle.

A gauge 148 (see also FIGS. 1 and 2) attached to the carriage 34 has markings 150 (FIG. 12) readable in drill bit types, that is to say, wood, plastic, aluminum, steel, cast iron and bronze. Drill bits for such materials characteristically have clearance angles relatively large for wood and plastic and progressively smaller for, aluminum, steel, cast iron and bronze. A pointer 152 attached to the tool holder post 20 is positioned to sweep along the gauge 148.

The gauge 148, since it is attached to the carriage, measures the true angle F of the drill bit relative to the grinding surface 10, even though the adjustment is accomplished by changing the drill holder position relative to the rocker arm 24.

An adjustable stop screw 154 attached to the companion arm 138 of the stop bracket 130 has a path of movement on the opposite side of, and intercepted by, the stop 144. The extent of the bit holder swing is accordingly limited.

(g) FEED ECCENTRIC ACTUATOR AND MEMORY

In order to achieve the grinding and resurfacing of the lip, the work or drill bit must be very slightly advanced towards the grinder surface as the bit rotates about the swing axis. The process is best done gradually or in small increments. Thus, the swing axis is moved only slightly after each excursion of the bit holder through its arc until satisfactory resurfacing is provided. If the resurfacing required is extensive, a rough finishing of the drill bit may be done by hand preparatory to use of the resurfacing machine.

In order to advance the swing axis quite minutely for the foregoing purposes, the stop roller 42 (FIG. 4) is moved. This is achieved by angularly moving the feed shaft, since the stop roller 42 is mounted on an eccentric extension 44 thereof. For this purpose, a manually operated lever or actuator rod 156 is provided which projects radially from a collet 158 affixed to the extension 44. Movement of the rod 156 in the direction to retract the stop roller 42 and to retract the swing axle 32, is limited by a stop bar 160 which projects laterally from the tiltable standard 48. When the stop bar 160 is engaged by the rod 156, the stop roller 42 is in its nadir position as indicated in FIG. 2. Movement of the rod in the direction to advance the stop roller 42 and to advance the swing axle, is also limited by the stop bar 160. For this purpose, a pin 162 is provided that projects from the collet 158 at a position about 140° or 150° from the actuator rod 156.

From the nadir position, the actuator rod 156 is slightly moved and the bit holder is moved through its swing arc. The actuator rod 156 is then slightly moved farther and the process repeated. Just how far the swing axle 32 has moved from the initial position is quite important to duplicate when the companion drill bit lip is positioned. Thus, only by exact symmetrical treatment of both lip surfaces will the drill bit operate efficiently with equal division of load and rapid, smooth cutting of the work. In order to mark just exactly how far the actuator rod 156 moved during surfacing to the first lip, a marker rod or memory stick 164 is provided. The marker rod 164 projects from a collet 166 (FIG. 4) which is frictionally and yieldably fitted on an embossment through which the feed shaft 46 projects.

The free end of the marker rod 164 has a bent end 170 that projects into the path of the actuator rod 156. In practice, the marker rod 164 is moved to a starting position when the actuator rod 156 is moved to its starting position for the first of the lip surfaces to be ground. The marker rod 164 will then be carried along through the course of movement of the actuator rod 156. Finally, when the actuator rod 156 is returned to its starting position for the second lip surface, the marker rod 164 remains at the maximum position to which it was moved by the actuator rod 156. Exactly the same swing axis movement for the second lip will be achieved by reference to the position marked by the marker rod 170, and precise symmetry will be achieved.

(h) INDEX CONTROL AND ARBOR CLAMP

Figures 5, 6, 7, 8:
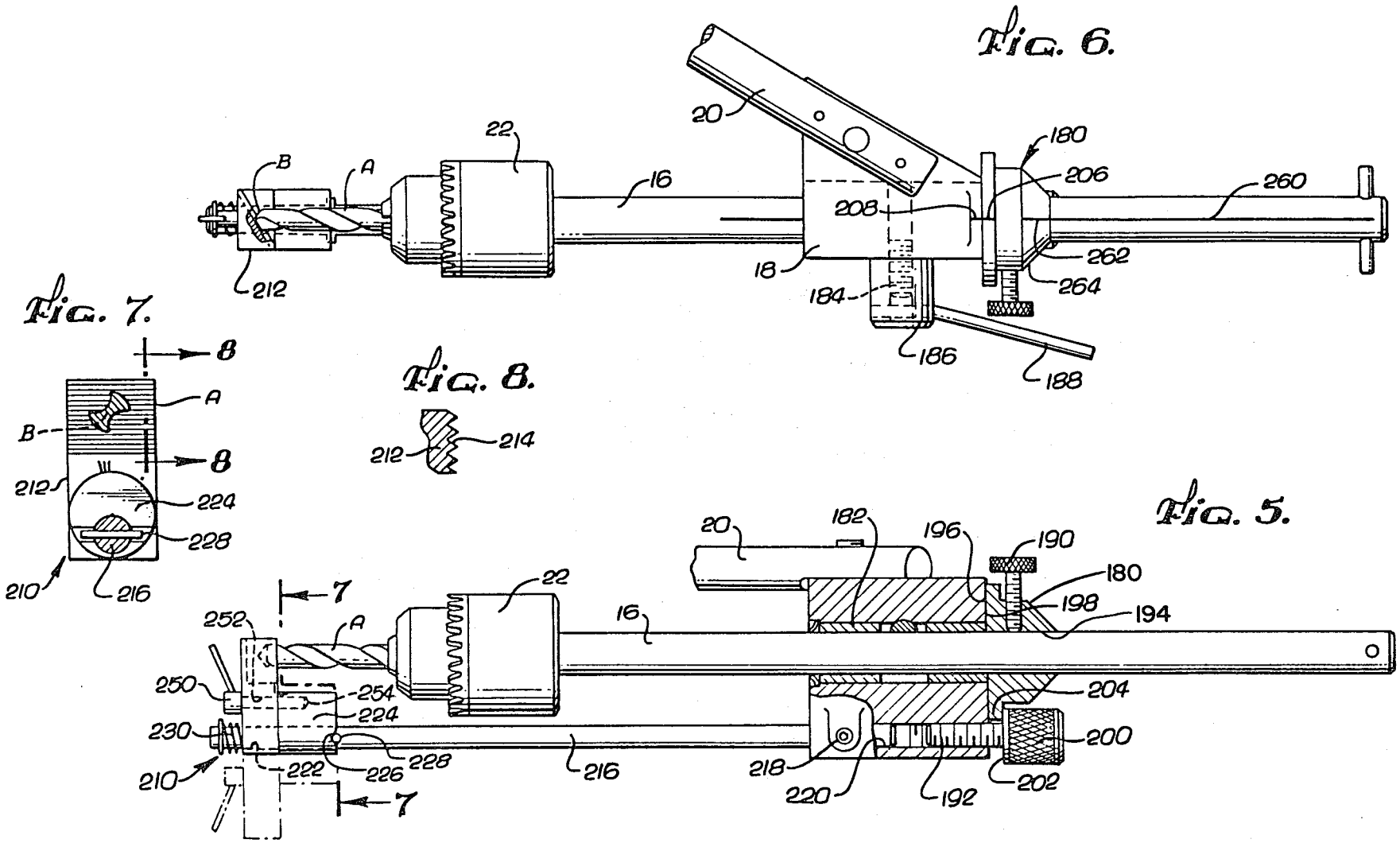
FIG. 5 is a fragmentary view of the frontal part of the bit holder, part being shown in section and part being shown in elevation; the view being taken along the plane indicated by lines 5—5 of FIG. 1. The chisel point angle gauge is shown in position.
FIG. 6 is a fragmentary top plan view of the bit holder similarly illustrating the chisel point angle gauge in operative position.
FIG. 7 is an enlarged transverse sectional view taken along a plane corresponding to lines 7—7 of FIG. 5 and showing the chisel point angle gauge markings.
FIG. 8 is a further enlarged fragmentary sectional view taken along a plane corresponding to lines 8—8 of FIG. 7 and showing the surface configuration of the chisel angle gauge.

In order accurately to reposition the arbor 16 to a new index position following grinding of the first of two lip surfaces, an index ring 180 (FIGS. 5 and 6) is provided. The index ring 180 cooperates with the arbor housing 18 and with the arbor 16 itself to achieve this purpose. The arbor housing 18 mounts a bushing 182 (FIG. 5) to which the arbor is releasably clamped in order to hold the arbor firmly in definite angular and axial positions during the resurfacing process. A draw screw 184 locks and unlocks the arbor relative to the bushing. An actuator 186 having a handle 188 operates the draw screw 184.

The index ring 180 is releasably locked to the arbor 16 by a radial clamp screw 190. Furthermore, the index ring 180 is releasably held against the housing 18 by the aid of an axial clamp screw 192. If the axial clamp screw 192 and draw screw 184 are released while the radial clamp screw 190 is set, the arbor 16 can then be exactly moved 180° by aligning suitable gauge marks between the index ring 180 and the housing 18. The draw screw 184 and the axial clamp screw 192 can then be closed precisely to position the second lip for symmetrical grinding.

The index ring 180 has a through bore 194 aligned with the split clamp bushing 182. The bore 194 is long enough to ensure a stable mutually guided relationship between the index ring 180 and the arbor 16. The index ring has a flat surface 196 that engages a companion flat surface 198 at the end of the housing 18. The axial clamp screw 192 has a head 200 that provides a shoulder 202. The shoulder 202 cooperates with an annular flange 204 of the index ring 180 to confine the index ring against the housing 18.

In order to gauge the angular position of the index ring 180, the peripheral portion of its flange 204, in the present instance, has two marks. One of the marks 206 (FIG. 6) is shown in alignment with a mark 208 of the housing 18. The second mark on the index ring is not visible in FIG. 6, but is located exactly 180° from the first mark. Hence, an exact index movement of the arbor 16 can be provided.

Of course, additional markings can be provided on the index ring 180 in the event that three or four flute drills are to be ground.

(i) CHISEL POINT ANGLE CONTROL

The drill bit A is initially set in the chuck 22 so that the lip to be surfaced is exactly horizontal, or parallel to the swing axis C. This is achieved by a chisel angle gauge 210 shown in FIGS. 5 to 8. The gauge includes an angled block 212 provided with a series of parallel grooves 214 (FIGS. 7 and 8) to which one of the drill bit lips B can be visually aligned. The gauge block 212 is located frontally of the drill grinder so as to be accessible and easily swingable to a retracted position without interference with the companion mechanisms. With this orientation, it is most convenient for the gauge to cooperate with the lip 180° from the one about to be ground.

The gauge block 212 is swingably supported at the distal end of a supporting rod 216. The supporting rod 216 extends in spaced parallel relationship to the arbor 16, its proximal end being secured in a socket 220 of the housing 18 by a clamp screw 218. The socket 220 is located at the frontal portion of the housing 18 beneath the arbor 16. Conveniently, the socket 220 is formed as the frontal part of a bore, the rearward portion of which threadedly mounts the axial clamp screw 192.

The gauge block 212 has a mounting hole 222 by the aid of which it is swingable either to address the gauge grooves to the drill bit A or to retract the block out of the path of the drill bit. To determine an exact angular position of the gauge block 212 when in operative position, a detent mechanism is provided. The detent mechanism includes a companion snap part 224 in the form of a short cylinder secured to the rearward face of the gauge block 212 for angular movement therewith. The snap part 224 has a detent recess 226 at its rearward face that engages a detent pin 228 projecting radially on opposite sides of the supporting rod 216. See also FIG. 7. A small spring 230 on the rod 216 on the opposite or frontal side of the gauge block urges both the gauge block 212 and the snap part 224 in a direction to seat on the detent pin 228. The gauge block may be manually moved to operative or retracted position.

The gauge grooves 214 are formed on a surface inclined to the axis of the drill bit in an amount corresponding to the included point angle of the drill.

In order to calibrate the gauge block position, or in order to adjust the gauge block position for special drill bits, the angular position between the gauge block 212 and the snap part 224 may be adjusted. For this purpose a clamp screw 250 is provided that extends with clearance through a hole 252 in the gauge block threadedly to engage a registering recess 254 in the snap part 224. The clearance allows a slight angular movement between the gauge block 212 and the snap part 224. The head of the screw 250 secures the parts in an angularly adjusted position.

(j) SECURING DRILL BIT IN PREPARATION FOR GRINDING

Before the drill bit is fixed to the chuck in the position determined by the gauge 210, and before the arbor 16 is secured to the bushing 182, the grinding wheel 12 is dressed, the swing axle 32 is positioned for proper drill bit size, and the clearance angle for the drill bit type is selected. Additionally, the position of the contour cam 58, to be hereinafter more fully described, is preferably also adjusted in advance.

To prepare for grinding, one of the marks 206 of the index ring 180 is lined up with the housing mark 208. The axial clamp screw 192 is drawn closed, but the draw screw 184 and the radial clamp screw 190 are released. The drill bit is inserted into the chuck 22 as deeply as it will go, but in any case, leaving about 1¼" exposed for best support of the drill bit. The chuck is tightened by hand so that the bit is snugly but yieldably held. The gauge block 212 is moved into position and the arbor 16 is advanced so that the drill cutting lip cooperable with the gauge block 212 is nearly in contact. The angular position of the arbor 16 relative to the index ring 180 is now fixed and referenced. For this purpose, the arbor has a longitudinal reference line 260 extending throughout the necessary length. This line 260 is straight and parallels the arbor axis. The reference line 260 cooperates with a reference mark 262 at the rear hub 264 of the index ring 180. The draw screw 184 is now closed and the arbor 16 is firmly held while the drill bit is moved by hand to line up with the gauge block grooves 214. The chuck 22 is then firmly tightened and chisel angle gauge moved back out of the way.

The arbor draw screw 184 is now released, allowing the drill bit to be advanced to the grinding wheel 12 to within fifteen or thirty thousands of an inch, as may be determined by a shim gauge. The reference line 260 is repositioned into alignment with the reference mark 262 in case the arbor 16 has moved angularly. The draw screw 184 is now operated to lock the arbor. It is thus ensured that the arbor is in the same angular position that it was when the lip was located. Now, for the first time, the radial clamp screw 190 for the index ring is closed, securing all of the parts together. Grinding proceeds as previously described.

When the grinding of the first lip is completed, the feed actuator rod 156 (FIG. 2) is returned, the extent of its movement being carefully marked by the memory rod 164. Now, the arbor 16 is freed for angular movement to its new position. The draw screw 184 is released. Since the arbor is also locked to the index ring 180, the axial clamp screw 192 must be released. Now the arbor 16 can be rotated until the opposite index ring mark 206 (FIG. 6) is aligned with the housing mark 208. The two clamps are then reclosed. It is thus ensured that the second lip surface grinding will take place at exactly the same axial poisition of the drill bit, the arbor 16 being held by the index ring 180. Furthermore, the second position is exactly 180° from the first. The second lip surface is now ground to a point determined by the memory rod 164.

(k) SPECIAL LIP SURFACE CONTOUR

Figure 20:
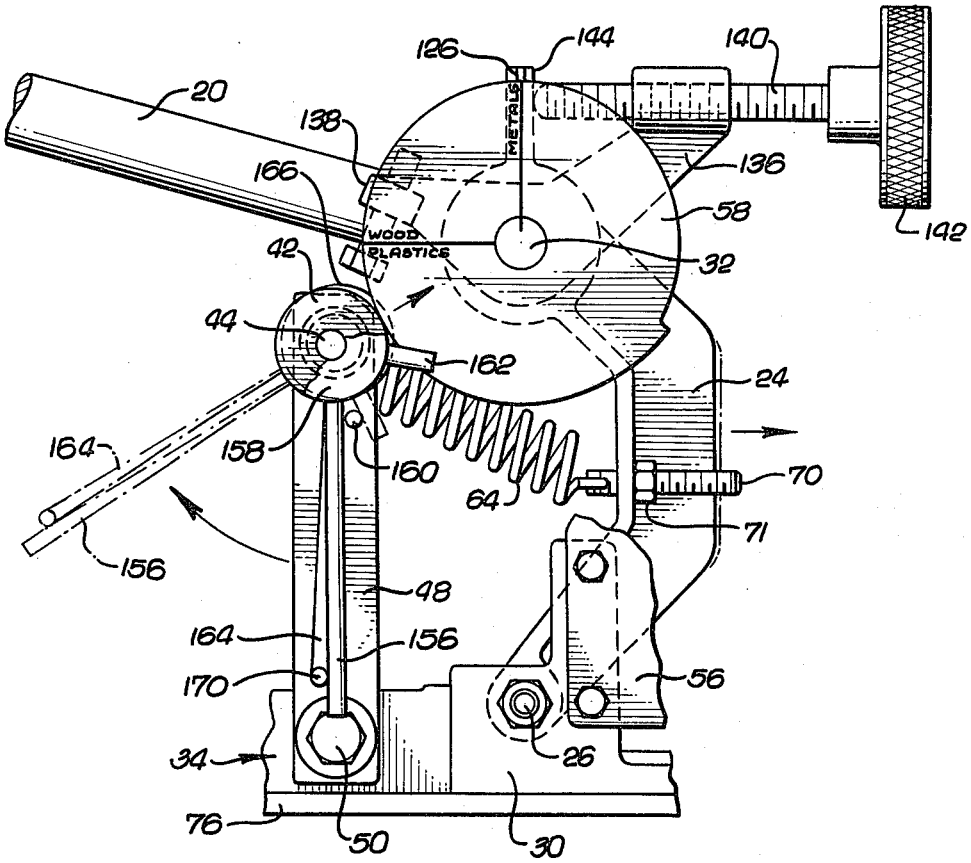
FIG. 20 is a fragmentray rear elevational view of the eccentric actuator and associated cam contour mechanism for determining deviation, if any, of the lip surface from a true cylindrical form. Part of the actuator collet is broken away to reveal the feed roller.
Figure 21:
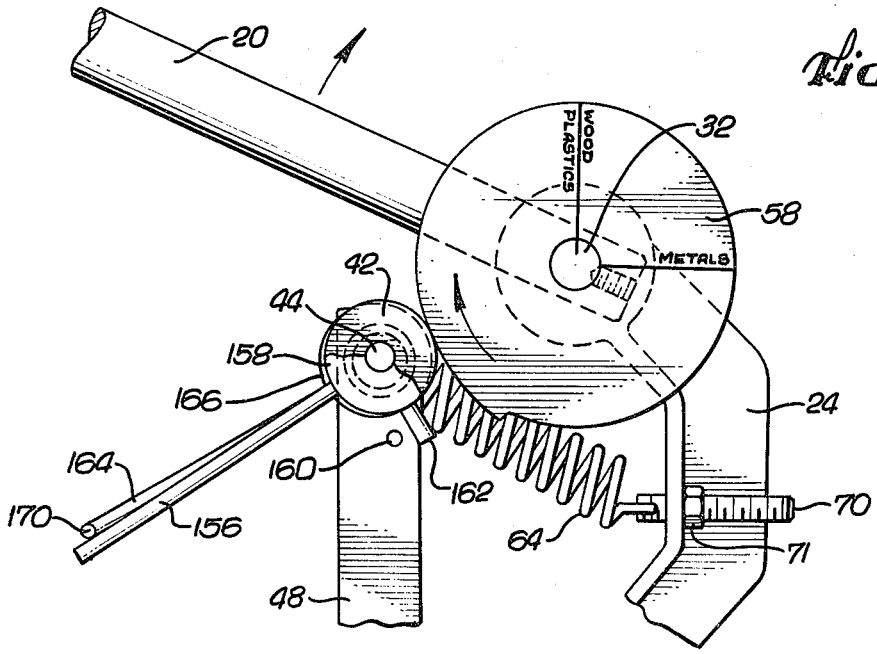
FIG. 21 is a view companion to FIG. 20 and showing the cam contour mechanism in an alternate position for providing a lip surface suitable for cutting wood or plastic.

Ordinarilly, the lip surface for metal drill bits is desirably cylindrical, whatever the lip clearance may be. In some instances, drill bit efficiency can be improved by changing the curvature of lip surface as a function of distance from the lip. Special lip surface contour may be provided by the contour cam 58 shown in FIGS. 20 and 21. The contour cam 58 rotates with the bit holder as previously described. Consequently, the cam surface moves to position different portions for contact with the feed roller. The angular movement of the bit holder and hence the operative arc of the contour cam may be 40° more or less. Part of the cam arc is cylindrical, and this part is operative when the contour cam 58 is in an angular position illustrated in FIG. 20, as indicated by uppermost orientation of a mark METALS. By resetting the contour cam to position another mark WOOD/PLASTICS, a non-cylindrical part of the cam arc is positioned, resulting in a curvature of the lip surface other than cylindrical.

(l) MODIFICATIONS

The precision drill bit grinding apparatus, in the present instance, has a small chuck. If the machine is intended to resurface taper shank drill bits, a different arbor structure may be provided to incorporate a locking ring for such drill bits. Obviously, various modifications may be made consistent with the spirit of the present invention, the illustration of but one embodiment being in no way limiting.

Intending to claim all novel, useful and unobvious features shown or described, I make the following claims:

1. In a surfacing tool for a multiple lipped drill bit cooperable with a surface of a grinding wheel, (a) a holder for the drill bit to be surfaced;

(b) a pivot block;

(c) means mounting the holder on the pivot block for movement about a swing axis;

(d) means mounting the pivot block for movement in a path which orients the swing axis substantially parallel to the operative surface of the grinding wheel, movement of said pivot block in its said path moving said swing axis towards and away from said operative surface;

(e) means forming a stop for limiting movement of said pivot block in its said path;

(f) means urging said pivot block normally to engage said stop;

(g) means movably mounting the stop for determining a starting position of the stop and a corresponding position of the swing axis in accordance with the size of the drill bit to be surfaced;

(h) feed means mounted on the stop for micrometric work stroke movement of the pivot block and the drill bit holder mounted thereon; and (i) marker means for providing a memory as to the excursion of said feed means so that said excursion can be exactly duplicated for all drill bit lips.

2. The surfacing tool as set forth in claim 1 in which said stop comprises a roller eccentrically mounted on a shaft projecting from a hub; said feed means comprising, in combination with said shaft and said eccentrically mounted roller, an actuator connected to said roller; means determining a normal starting position of said actuator in which said eccentric roller is approximately in its nadir position; said marker means comprising a collet frictionally mounted on said shaft hub, and a rod projecting substantially radially from the collet with a part of the rod projecting into the path of said actuator.

3. The surfacing tool as set forth in claim 1 in which said pivot block mounting means comprises a carriage and a base plate mounting said carriage for movement in a straight path perpendicular to said swing axis; means micrometrically moving said carriage on said base plate; an arm pivotally mounted by the carriage for movement in a path about an axis parallel to said straight path, and a grinding wheel dressing tool mounted on said arm; said arm being arcuately movable to cause said tool to traverse across the surface of said grinding wheel.

4. In a surfacing tool for a multiple lipped drill bit cooperable with a surface of a grinding wheel, (a) a holder for the drill bit to be surfaced;

(b) a pivot block;

(c) means mounting the holder on the pivot block for movement about a swing axis;

(d) means mounting the pivot block for movement in a path which orients the swing axis substantially parallel to the operative surface of the grinding wheel, movement of said pivot block in its said path moving said swing axis towards and away from said operative surface;

(e) means forming a stop for limiting movement of said pivot block in its said path;

(f) means urging said pivot block normally to engage said stop;

(g) means movably mounting the stop for determining a starting position of the stop and a corresponding position of the swing axis in accordance with the size of the drill bit to be surfaced;

(h) feed means mounted on the stop for micrometric work stroke movement of the pivot block and the drill bit holder mounted thereon;

(j) said holder including a housing;

(k) an arbor mounted on the housing for angular and axial movement, and a clamp for releasably locking the arbor to the housing;

(l) said arbor having means at one end for releasably locking the shank of a drill bit;

(r) means forming a second stop to determine a limit to swing movement of said drill bit holder about said swing axis;

(s) said holder determining a skew relationship between the arbor axis and said swing axis;

(t) and means for adjusting the position of said second stop means thereby to determine the clearance angle ground on said drill bit.

5. The surfacing tool as set forth in claim 4 in which said stop comprises a roller eccentrically mounted on a shaft projecting from a hub; said feed means comprising, in combination with said shaft and said eccentrically mounted roller, an actuator connected to said roller; means determining a normal starting position of said actuator in which said eccentric roller is approximately in its nadir position; marker means comprising a collet frictionally mounted on said shaft hub, and a rod projecting substantially radially from the collet with a part of the rod projecting into the path of said actuator.

6. In a surfacing tool for a multiple lipped drill bit cooperable with a surface of a grinding wheel, (a) a holder for the drill bit to be surfaced;

(b) a pivot block;

(c) means mounting the holder on the pivot block for movement about a swing axis;

(d) means mounting the pivot block for movement in a path which orients the swing axis substantially parallel to the operative surface of the grinding wheel, movement of said pivot block in its said path moving said swing axis towards and away from said operative surface;

(e) a roller eccentrically mounted on a shaft projecting from a hub, said roller forming a stop limiting movement of said pivot block in its said path;

(f) biasing means urging said pivot block normally to engage said stop;

(g) means movably mounting said hub for determining a starting position of the stop and a corresponding position of the swing axis in accordance with the size of the drill bit to be surfaced;

(h) an actuator connected to said eccentric roller;

(u) a cam connected to said drill bit holder and angularly movable therewith, said cam being interposed between said pivot block and said eccentric roller; and (v) means for selecting the angular position of the cam relative to said tool bit holder for determining the contour of the lip surface ground by said grinding wheel.

7. The surfacing tool as set forth in claim 6 together with, (i) marker means for providing a memory as to the excursion of said eccentric roller so that said excursion can be exactly duplicated for all drill bit lips.

8. In a surfacing tool for a multiple lipped drill bit cooperable with a surface of a grinding wheel, (a) a holder for the drill bit to be surfaced;

(b) a pivot block;

(c) means mounting the holder on the pivot block for movement about a swing axis;

(d) means mounting the pivot block for movement in a path which orients the swing axis substantially parallel to the operative surface of the grinding wheel, movement of said pivot block in its said path moving said swing axis towards and away from said operative surface;

(e) means forming a stop for limiting movement of said pivot block in its said path;

(f) means urging said pivot block normally to engage said stop;

(g) means movably mounting the stop for determining a starting position of the stop and a corresponding position of the swing axis in accordance with the size of the drill bit to be surfaced;

(h) feed means mounted on the stop for micrometric work stroke movement of the pivot block and the drill bit holder mounted thereon;

(j) said holder including an arbor mounted for angular and axial movement about an axis;

(k) clamping means for releasably locking said arbor in a selected axial and angular position;

(l) said arbor having means at one end for releasably locking the shank of a drill bit to be coaxial with said arbor axis;

(m) said holder determining a skew relationship between said swing axis and said arbor axis;

(n) means forming a second stop to determine a limit to the swing movement of said drill bit holder about its swing axis, and corresponding to a starting position for surface grinding of said drill bit;

(o) means biasing said arbor normally to engage said second stop;

(p) the starting position of said drill bit holder determined by said second stop positioning the drill bit point at the grinding wheel on that side of the plane through the swing axis and normal to the grinding wheel surface that is opposite the side of said normal plane where the arbor axis is situated, thus to determine the clearance angle of the drill bit to be surfaced;

(q) movement of said arbor away from said second stop causing said drill bit point to move farther away from said normal plane.

9. The surfacing tool as set forth in claim 8 in which said stop comprises a roller eccentrically mounted on a shaft projecting from a hub; said feed means comprising, in combination with said shaft and said eccentrically mounted roller, an actuator connected to said roller; means determining a normal starting position of said actuator in which said eccentric roller is approximately in its nadir position; marker means comprising a collet frictionally mounted on said shaft hub, and a rod projecting substantially radially from the collet with a part of the rod projecting into the path of said actuator.

* * * * *